US009376776B2

(12) United States Patent
Kempken

(10) Patent No.: US 9,376,776 B2
(45) Date of Patent: Jun. 28, 2016

(54) HIGH-PRODUCTION ROUTING DEVICE

(71) Applicant: Gary Kempken, Rochester, WI (US)

(72) Inventor: Gary Kempken, Rochester, WI (US)

( * ) Notice: Subject to any disclaimer, the term of this patent is extended or adjusted under 35 U.S.C. 154(b) by 35 days.

(21) Appl. No.: 14/333,160

(22) Filed: Jul. 16, 2014

(65) Prior Publication Data

US 2016/0010292 A1 Jan. 14, 2016

Related U.S. Application Data

(60) Provisional application No. 62/024,329, filed on Jul. 14, 2014.

(51) Int. Cl.
*E01C 23/09* (2006.01)

(52) U.S. Cl.
CPC ..... *E01C 23/0933* (2013.01)

(58) Field of Classification Search
CPC ..... E01C 23/09; E01C 23/0933
See application file for complete search history.

(56) References Cited

U.S. PATENT DOCUMENTS 1,553,845 A * 9/1925 Bardol ..... E01C 23/0933 299/39.3
3,043,200 A * 7/1962 Huttash ..... E01C 23/08 134/17
3,747,981 A * 7/1973 Zuzelo ..... B23D 59/002 299/10
3,901,553 A * 8/1975 Binger ..... B23D 45/105 173/24
4,204,714 A * 5/1980 Jacobson ..... E01C 23/0933 299/1.5
4,778,304 A * 10/1988 Baldi ..... B28D 1/045 125/14
4,797,673 A * 1/1989 Dombrowski ..... G01S 7/032 180/169
6,099,080 A * 8/2000 Hirashita ..... E01C 23/088 125/13.01
6,470,874 B1 * 10/2002 Mertes ..... B23D 47/12 125/12
2005/0207841 A1 * 9/2005 Holl ..... E01C 23/088 404/94

* cited by examiner

*Primary Examiner* — John Kreck
(74) *Attorney, Agent, or Firm* — Absolute Technology Law Group, LLC

(57) ABSTRACT

A high-production routing device has a drive frame with an operator area and an open deck. The open deck includes angularly disposed deck bars allowing an unobstructed view of a work surface. In the drive frame geometry, a line drawn from a center of mass of the device to a most lateral point of the drive frame forms an angle ranging between about 0 degrees and about 60 degrees. The device also has a hydraulic pump and a hydraulic reservoir. The device further includes a routing drum with multiple rotors, each freely and independently rotating about a shaft. Each rotor includes several radially disposed blades, which rout the work surface. The device also has at least one single wheel drive assembly for driving and steering, including a hydraulic drive motor and a hydraulic steering motor operatively coupled to the hydraulic pump and to a precision drive-steerable wheel.

21 Claims, 2 Drawing Sheets

HIGH-PRODUCTION ROUTING DEVICE

CROSS-REFERENCE TO RELATED APPLICATIONS

This application claims priority to U.S. Provisional Application No. 62/024,329 filed on Jul. 14, 2014.

FIELD OF INVENTION

This invention relates to the field of in situ disintegration of hard material, and more specifically to a drum-type rotary cutter.

BACKGROUND

Repair and life extension of roadways is a critical role of government and is one of the most significant costs to our nation. There is widespread concern that repairs of roadway infrastructure are underfunded. States would collectively need to spend $43 billion every year for 20 years to bring roads currently in poor condition up to good condition. Estimates classify more than 73,000 miles of road in "fair" or "poor" condition.

A substantial portion of the $43 billion spent yearly on roadway repair is for the labor component of crack repair and sealing. Substantial research is funded each year to maximize the productivity of crack sealing projects, including technological improvements to sealers and fillers. Additional research is directed toward decreasing exposure of highway workers to traffic, and to minimizing maintenance delays for the traveling public. With proper and timely application, crack sealing and filling can extend the life of roadways, and realize returns as high as $16.00 for every dollar spent.

To date, there have been few or no technological developments directed to increasing the productivity of labor expended on roadway projects.

Creak sealing is a process in which a worker plugs a crack with an elastic sealant material that protects against moisture infiltration, after routing the crack by walking backwards along the length of the crack and pulling routing tool. The worker-propelled router allows the worker to create a clean, dry, reservoir by cutting away portions of the roadway material surrounding the crack. This allows cracks to be evenly sealed with the elastic sealant material and prevents the sealant from becoming dislodged.

A typical worker can rout half a mile worth of cracks per day, at an average national wage of $14-25 an hour. Approximately 20-40% of the cost of a road crack-filling project is attributable to this labor. The cost per project mile of crack filling project is approximately $8,000 per mile, with about $1,600 to $3,200 of this cost being assigned to routing labor costs.

Crack routing can inflict additional damage on the pavement, if not done properly, and is often the slowest activity in sealing operations. Because the routing process uses impact of a rotating blade or bit to cut the cracks, routers must be carefully guided along the crack by a worker with sufficient physical strength to control the process. Because routers presently known in the art are physically pulled along a crack by a worker, the speed is limited by the worker's physical strength. As the worker tires, the process becomes increasingly slow and error prone.

Attempts have been made in the art to develop routers that are less error-prone, such as a routing machine with increased weight. Unfortunately, this makes the machine more difficult and tiring for an operator to pull, and therefore slower to move. Any benefit gained in precision is lost due to the slower production time.

There is an unmet need for a high-production routing device that can increase the amount of routing that can be accomplished per labor hour.

There is an unmet need for a high-production routing device that can be precisely and easily steered along a crack.

SUMMARY OF THE INVENTION

The current invention is a high-production routing device. The routing device has a drive frame with an operator area and an open deck. The open deck includes at least two angularly disposed deck bars, placed to provide an unobstructed line of sight to a work surface viewed between the angularly disposed deck bars. In the drive frame geometry, a line drawn from a center of mass of the device to a most lateral point of the drive frame forms an angle ranging between about 0 degrees and about 60 degrees. The routing device also has a hydraulic pump operatively coupled to a hydraulic reservoir. The routing device also includes a routing drum. This routing drum includes multiple rotors, each freely and independently rotating about a shaft. Each rotor also has several radially disposed blades around a periphery of each rotor. The routing device also has at least one single wheel drive assembly. This assembly includes a hydraulic drive motor operatively coupled to the hydraulic pump and to at least one precision drive-steerable wheel. The routing device further includes a hydraulic steering motor operatively coupled to the hydraulic pump and to the drive-steering wheel.

DETAILED DESCRIPTION OF INVENTION

Figure 1A:
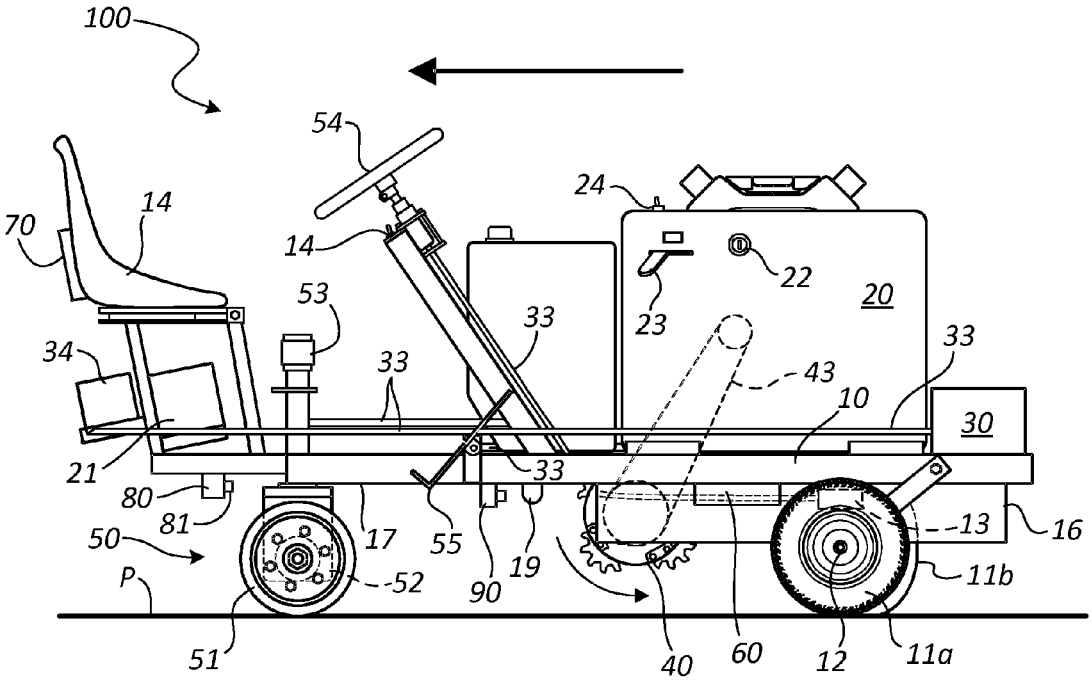
FIGS. 1*a* and 1*b* are opposing side of views of an exemplary embodiment of a high-production routing device.

For the purpose of promoting an understanding of the present invention, references are made in the text to exemplary embodiments of a high-production routing device, only some of which are described herein. It should be understood that no limitations on the scope of the invention are intended by describing these exemplary embodiments. One of ordinary skill in the art will readily appreciate that alternate but functionally equivalent elements may be used. The inclusion of additional elements may be deemed readily apparent and obvious to one of ordinary skill in the art. Specific elements disclosed herein are not to be interpreted as limiting, but rather as a basis for the claims and as a representative basis for teaching one of ordinary skill in the art to employ the present invention.

It should be understood that the drawings are not necessarily to scale. Instead, emphasis has been placed upon illustrating the principles of the invention. Like reference numerals in the various drawings refer to identical or nearly identical structural elements.

Moreover, the terms "about," "substantially" or "approximately" as used herein may be applied to modify any quantitative representation that could permissibly vary without resulting in a change in the basic function to which it is related.

Figure 1B:
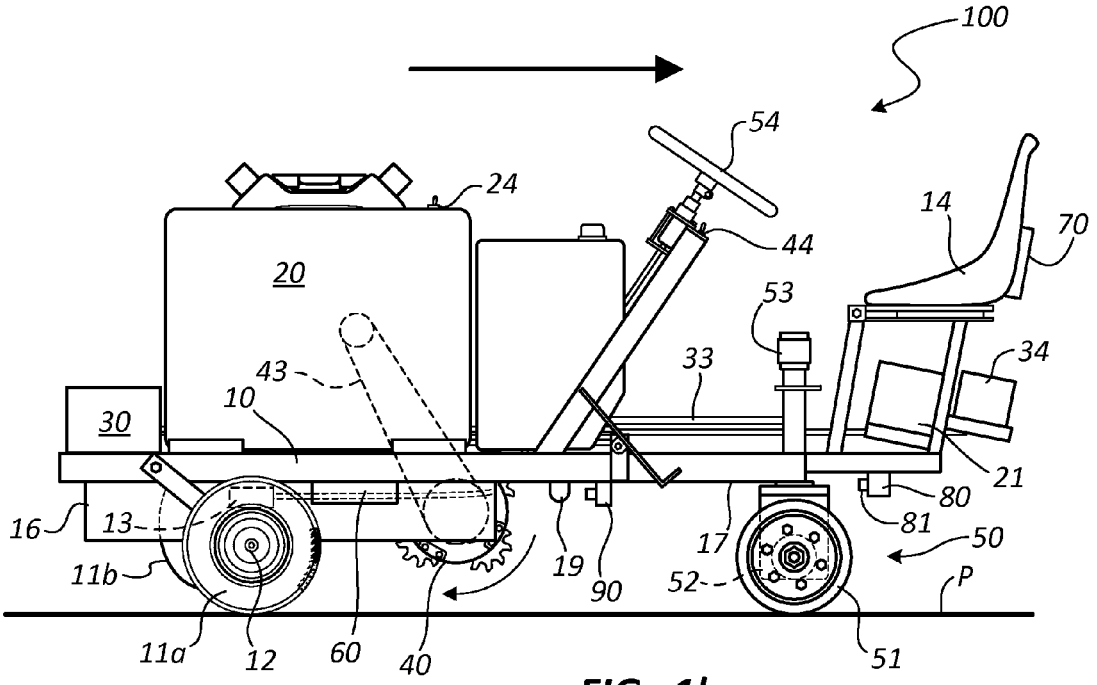

FIGS. 1*a* and 1*b* are opposing side of views of an exemplary embodiment of a high-production routing device 100. High-production routing device 100 includes a drive frame 10, an engine 20, a hydraulic pump 30, a routing drum 40, at least one single wheel drive assembly 50, an optional dust vacuum system 60, an optional backup sensor system 70 and an optional lighting system 80.

Drive frame 10 includes fixed wheels 11*a* and 11*b*, an axle 12, a hydraulic cylinder 13, a hydraulic actuator 14, an operator area 15 and a safety shroud 16. The overall length of drive frame 10 has a value of between about 42 inches and about 48 inches. This important length allows an operator sufficient room to view a work surface below drive frame 10, without being so long as to make high-production routing device 100 unwieldy and dangerous to operate.

Fixed wheels 11*a* and 11*b* extend laterally from drive frame 10 and are not steerable. In the exemplary embodiment, fixed wheels 11*a* and 11*b* are the most laterally located elements of high-production routing device 100. This allows placement of fixed wheels 11*a* and 11*b* to determine the tipping resistance of high-production routing device 100. In the exemplary embodiment, a line drawn from fixed wheels 11*a* and 11*b* to a center of mass of high-production routing device 100 forms an angle of 45 degrees from horizontal. In other embodiments, fixed wheels 11*a* and 11*b* are located so that the line forms an angle of between about 0 and about 60 degrees from horizontal. Axle 12 between fixed wheels 11*a* and 11*b* operatively connects to hydraulic cylinder 13, which operatively connects to hydraulic actuator 14. Actuating hydraulic actuator 14 causes hydraulic cylinder 13 to rotate axle 12, thereby raising and lowering drive frame 10.

In the exemplary embodiment, operator area 15 is at least one weight-bearing seat where an operator may sit during operation of high-production routing device 100. In other embodiments, operator area 15 is at least one weight bearing standing platform where an operator may stand during operation of high-production routing device 100. Weight born by operator area 15 is counterbalanced by the placement of engine 20 operatively coupled to a front portion of drive frame 10.

Safety shroud 16 surrounds a majority of routing drum 40. Attached to the underside of drive frame 10, safety shroud 16 reduces the amount of dust and other particulates scattered across the work surface by routing drum 40 during operation. This also provides an increased measure of safety to the operator and any nearby crewmembers. When hydraulic cylinder 13 completely lowers drive frame 10, a front portion of safety shroud 16 contacts the work surface. Safety shroud 16 has a height of between about 5 inches and about 15 inches. Safety shroud 16 surrounds routing drum 40 along a circumference of between about 17 inches to about 27 inches.

Engine 20, operatively coupled to a front portion of drive frame 10, provides power to all portions of high-production routing device 100. Engine 20 has a horsepower rating from about 5 hp to about 40 hp. Engine 20 operatively connects to battery 21, starter 22, throttle 23 and at least one kill switch 24. Battery 21 provides initial power to start engine 20 when an operator actuates starter 22. Throttle 23 allows an operator to increase or decrease the power output by engine 20, for example, to increase the speed at which high-production routing device 100 travels. At least one kill switch 24 allows an operator to immediately shut down engine 20 in case of mishap.

Engine 20 also provides power to hydraulic pump 30. Hydraulic pump 30 includes a first port 31 and a second port 32. A plurality of hydraulic lines 33 operatively connect hydraulic pump 30 to hydraulic reservoir 34. Hydraulic lines 33 also interconnect, to varying degrees, to all other hydraulic components of high-production routing device 100. Hydraulic reservoir 34 contains a volume of hydraulic fluid of about 5 gallons to about 7 gallons, sufficient to pressurize and operate all hydraulic components of high-production routing device 100.

Routing drum 40 mounts to drive frame 10 and has a diameter of between 6 and 36 inches. Linkage assembly 43 operatively connects routing drum 40 to engine 20, causing routing drum 40 to spin when engine 20 is active. Routing drum 40 rotates in a direction such that any debris ejected by routing drum 40 travels in a direction opposite the direction of travel of high-production routing device 100. Lowering drive frame 10 also lowers routing drum 40, allowing routing drum 40 to cut away at the work surface and rout a crack.

Single wheel drive assembly 50 operatively couples to drive frame 10 and includes at least one precision drive-steerable wheel 51, which operatively couples to both hydraulic drive motor 52 and hydraulic steering motor 53. Single wheel drive assembly 50 provides powered drive and enhanced steering capability to high-production routing device 100.

Hydraulic drive motor 52 causes rotation of precision drive-steerable wheel 51, thereby driving high-production routing device 100. Hydraulic drive motor 52 also operatively couples to both hydraulic pump 30 and directional actuator 55. Directional actuator 55 includes a first selectable position and a second selectable position. The first selectable position directs hydraulic fluid from first port 31 to operate hydraulic drive motor 52 in a first direction. The second selectable position directs hydraulic fluid from second port 32 to operate hydraulic drive motor 52 in a second direction. The second direction is opposite to the first direction, thereby allowing high-production routing device 100 to drive in both forward and backward directions. In one embodiment, directional actuator 55 includes a third selectable position in which prevents hydraulic fluid from operating hydraulic drive motor 52 and causes no rotation of precision drive-steerable wheel 51. In the exemplary embodiment, directional actuator 55 is a footplate. In other embodiments, directional actuator 55 may be, but is not limited to, a switch or a joystick.

Hydraulic steering motor 53 allows an operator to guide high-production routing device 100. Hydraulic steering motor 53 operatively couples to hydraulic steering mechanism 54, which in turn couples to hydraulic pump 30. An operator moving hydraulic steering mechanism 54 in any direction causes hydraulic steering motor 53 to pivot precision drive-steerable wheel 51 in the same direction, thereby steering high-production routing device 100. In the exemplary embodiment, hydraulic steering mechanism 54 is a steering wheel. In other embodiments, hydraulic steering mechanism 54 may be, but is not limited to, a joystick.

Optionally, high-production routing device 100 includes dust vacuum system 60. Dust vacuum system 60 is located under and operatively connected to drive frame 10, and is located within the circumference of safety shroud 16. Dust vacuum system 60 operatively couples to engine 20, which supplies power. In use, dust vacuum system 60 draws in dust produced from the work surface during crack routing. This prevents the dust from obscuring an operator's vision. Dust vacuum system 60 also prevents the operator or any nearby crewmembers from inhaling potentially hazardous dust, and prevents the dust from irritating mucous membranes.

Optionally, high-production routing device 100 includes backup sensor system 70. Because an operator routing a crack typically faces away from the direction of travel, backup sensor system 70 provides a warning if the operator is about to contact another person or a solid object. This warning may take the form of, but is not limited to, a visual warning, an audible warning, a tactile warning or any combination thereof. In the exemplary embodiment, backup sensor system 70 operatively couples to battery 21, which supplies power. In other embodiments, backup sensor system 70 receives power from engine 20. In the exemplary embodiment, backup sensor system 70 is located on the back of operator area 15. In other embodiments, backup sensor system 70 mounts directly to drive frame 10.

Optionally, high-production routing device 100 includes lighting system 80. Lighting system 80 is located under and operatively connected to drive frame 10. In the exemplary embodiment, lighting system 80 operatively couples to battery 21, which supplies power. In other embodiments, lighting system 80 receives power from engine 20. Lighting system 80 includes at least one lamp 81. Lamp 81 emits light toward the area in the unobstructed line of sight from the operator in operator area 15 to the work surface. In various embodiments, lamp 81 is an LED lamp or a filament lamp.

Optionally, high-production routing device 100 includes camera system 90. Camera system 90 is located under and operatively connected to drive frame 10. In the exemplary embodiment, camera system 90 operatively couples to battery 21, which supplies power. In other embodiments, camera system 90 receives power from engine 20.

Figure 2:
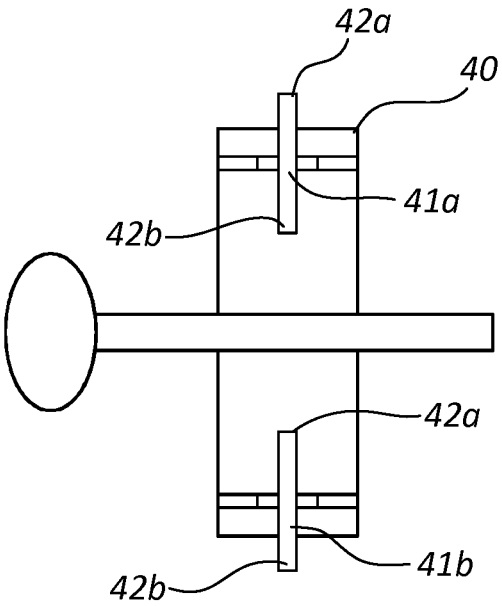
FIG. 2 illustrates a front view of a routing drum.

FIG. 2 illustrates a front view of routing drum 40. Routing drum 40 includes a plurality of rotors 41*a* and 41*b* connected to routing drum 40 by shafts, about which rotors 41*a* and 41*b* freely and independently rotate. While the exemplary embodiment shows two rotors, other embodiments may include up to 16 rotors. Each rotor includes a plurality of blades 42*a* and 42*b* radially disposed about a periphery of each rotor 41*a* and 41*b*. Blades 42*a* and 42*b* may be enhanced for more rapid cutting. While the exemplary embodiment shows two blades, other embodiments may include up to 12 blades. Rotors 41*a* and 41*b* and blades 42*a* and 42*b* may be made from materials including, but not limited to, steel, carbide or any combination thereof. Lowering routing drum 40 by lowering drive frame 10 allows blades 42*a* and 42*b* to contact the work surface. Contacting the work surface while spinning routing drum 40 causes blades 42*a* and 42*b* to cut away at the work surface, routing a crack.

Figure 3:
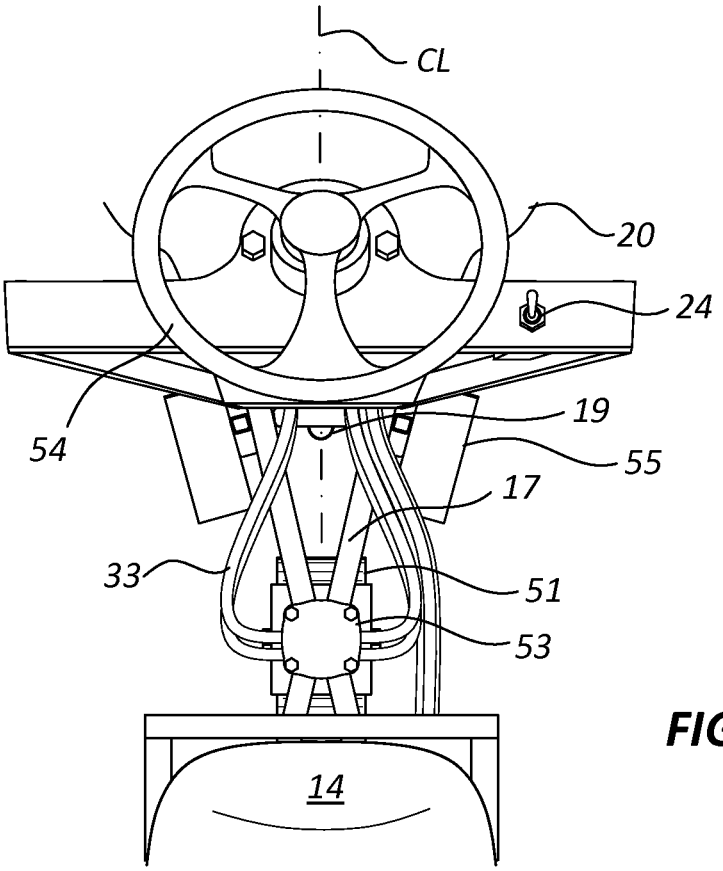
FIG. 3 illustrates a perspective view of a line of sight from an operator area to a work surface.

FIG. 3 illustrates a perspective view of a line of sight from operator area 15 to a work surface. Drive frame 10 further includes open deck 17, deck bars 18*a* and 18*b*, and at least one optional high-precision guide indicia 19. Open deck 17 includes at least two angularly disposed deck bars 18*a* and 18*b*. Deck bars 18*a* and 18*b* primarily extend along a longitudinal axis of high-production routing device 100 to provide structural support to open deck 17 and operator area 15. The angular placement of deck bars 18*a* and 18*b* provides an unobstructed line of sight from an operator in operator area 15 to a work surface viewed between angularly disposed deck bars 18*a* and 18*b*.

Optionally, at least one high-precision guide indicia 19 may be located on drive frame 10 along the unobstructed line of sight. This feature allows an operator to more effectively guide high-production routing device 100 along cracks or other features of the work surface. In various embodiments, high-precision guide indicia 19 is a linear, geometric shape, or arrow graphic marked on drive frame 10, a slot in drive frame 10, a laser pointer attached to drive frame 10 and directed towards the work surface, a plurality of brackets projecting from safety shroud 16 or drive frame 10, a protrusion projecting from safety shroud 16 or drive frame 10, or any combination thereof.

What is claimed is:

1. A high-production routing device, comprised of:

a drive frame, wherein a line drawn from a center of mass of said device to a most lateral point of said drive frame forms an angle to ground ranging between about 0 degrees and about 60 degrees, wherein said drive frame has an operator area and an open deck comprised of at least two angularly disposed deck bars, wherein each of said angularly disposed deck bars are placed to provide an unobstructed line of sight to a work surface viewed between said angularly disposed deck bars, wherein said at least two angularly disposed deck bars diverge from said operator area in a direction toward a routing drum;

a hydraulic pump operatively coupled to a hydraulic reservoir;

wherein said routing drum includes a plurality of rotors, wherein each of said plurality of rotors freely and independently rotates about a shaft, wherein each of said plurality of rotors has a plurality of radially disposed blades around a periphery of each of said plurality of rotors;

at least one single wheel drive assembly comprised of a hydraulic drive motor operatively coupled to said hydraulic pump and to at least one precision drive-steerable wheel; and a hydraulic steering motor operatively coupled to said hydraulic pump and to said at least one drive-steerable wheel.

2. The device of claim 1, wherein said operator area includes at least one weight-bearing seat, wherein said weight is counterbalanced by the placement of an engine operatively coupled to a front portion of said drive frame.

3. The device of claim 1, wherein said operator area includes at least one weight bearing standing platform, wherein said weight is counterbalanced by the placement of an engine operatively coupled to a front portion of said drive frame.

4. The device of claim 1, wherein said drive frame includes a hydraulic cylinder operatively connected to said hydraulic pump and configured to raise and lower said routing drum.

5. The device of claim 4, wherein said hydraulic cylinder is actuated by a hydraulic actuator.

6. The device of claim 1, wherein said drive frame includes at least one high-precision guide indicia selected from a group consisting of line, geometric shape, slot in bottom opening, arrow pointer, laser pointer, a plurality of projecting brackets, a projecting protrusion, or any combination thereof.

7. The device of claim 1, further comprising a safety shroud operatively coupled to said drive frame, wherein said safety shroud at least partially surrounds said routing drum.

8. The device of claim 1, further comprising an engine operatively coupled to said drive frame, wherein said engine has a horsepower rating from about 5 hp to about 40 hp.

9. The device of claim 1, wherein said routing drum has a diameter of about 6 inches to about 36 inches.

10. The device of claim 1, wherein said plurality of rotors comprise from 2 to 16 rotors.

11. The device of claim 1, wherein said plurality of radially disposed blades comprise from 2 to 12 radially disposed blades.

12. The device of claim 1, wherein said routing device further includes a hydraulic steering mechanism operatively interconnected between said hydraulic pump and said hydraulic steering motor.

13. The device of claim 1, wherein said routing device further includes a directional actuator operatively coupled to said hydraulic pump.

14. The device of claim 13, wherein said directional actuator includes a first selectable position and a second selectable position.

15. The device of claim 14, wherein said first selectable position directs fluid from a first port to operate said hydraulic drive motor in a first direction and wherein said second selectable position directs fluid from a second port to operate said hydraulic drive motor in a second direction opposite to said first direction.

16. The device of claim 1, wherein said angle is about 45 degrees.

17. The device of claim 1, wherein said routing device further includes a dust vacuum system operatively connected to said drive frame.

18. The device of claim 1, further comprising at least one backup sensor system.

19. The device of claim 1, further comprising at least one lighting system operatively coupled to said drive frame.

20. The device of claim 1, further comprising at least one camera system operatively coupled to said drive frame.

21. The device of claim 1, wherein said drive frame has a length of between about 42 inches and about 48 inches.

* * * * *